US012534857B2

(12) United States Patent
Lindemulder

(10) Patent No.: US 12,534,857 B2
(45) Date of Patent: Jan. 27, 2026

(54) ROADWAY SUPPORT SYSTEM FOR RAILWAY GRADE CROSSING

(71) Applicant: Holland, L.P., Crete, IL (US)

(72) Inventor: Paul Lindemulder, Saint John, IN (US)

(73) Assignee: Bedrock Rail Solutions LLC, Saint John, IN (US)

( * ) Notice: Subject to any disclaimer, the term of this patent is extended or adjusted under 35 U.S.C. 154(b) by 936 days.

(21) Appl. No.: 17/697,585

(22) Filed: Mar. 17, 2022

(65) Prior Publication Data

US 2022/0298728 A1 Sep. 22, 2022

Related U.S. Application Data

(60) Provisional application No. 63/162,195, filed on Mar. 17, 2021.

(51) Int. Cl.
*E01B 7/28* (2006.01)

(52) U.S. Cl.
CPC ..... *E01B 7/28* (2013.01)

(58) Field of Classification Search
CPC . E01B 7/28; E01B 21/00; E01B 21/02; E01B 21/04; E01B 2201/04
See application file for complete search history.

(56) References Cited

U.S. PATENT DOCUMENTS 1,979,790 A * 11/1934 Bell ..... E01C 9/04 238/8
3,863,840 A * 2/1975 Szarka ..... E01C 9/04 238/8
5,285,964 A * 2/1994 Vanotti ..... E01B 21/00 238/9
5,465,903 A * 11/1995 Davis ..... E01B 21/00 404/41

* cited by examiner

*Primary Examiner* — Robert J McCarry, Jr.

(74) *Attorney, Agent, or Firm* — Scherrer Patent & Trademark Law, P.C.; Stephen T. Scherrer; Monique A. Morneault

(57) ABSTRACT

An improved railway roadway crossing support system uses a foundation pile, support brackets and connecting hardware to provide vehicle traffic road support separated from the railroad ballast and track support system. The improved railway roadway crossing support system separates the roadway support system from the track support system so that the roadway support system can last longer and be repaired separately from the track support system.

20 Claims, 2 Drawing Sheets

ROADWAY SUPPORT SYSTEM FOR RAILWAY GRADE CROSSING

CROSS-REFERENCE TO RELATED APPLICATIONS

The present invention claims priority to U.S. Provisional Patent App. No. 63/162,195, titled "Roadway Support System for Railway Grade Crossing," filed Mar. 17, 2021, which is incorporated herein by reference in its entirety.

TECHNICAL FIELD

The present invention relates to an improved roadway support system for railway grade crossings that uses a foundation pile, support brackets and connecting hardware to provide vehicle traffic road support separated from the railroad ballast and track support system. The present invention separates the roadway support system from the track support system so that the roadway support system can last longer and be repaired separately from the track support system.

BACKGROUND

A roadway and railway grade crossing occurs where a railway and roadway intersect at the same level. There are more than 200,000 grade crossings in the U.S., and many require repairs and improvements. U.S. states, not the railroads, are typically responsible for evaluating grade crossing risks and prioritizing grade crossings for repairs and improvements. The crossing design, construction, and maintenance is often a coordinated effort among local, state, Department of Transportation, and railroads. Typically, the decision to install a specific type of crossing is with the state highway authority, not the railroads, and generally requires approval by the Federal Highway Administration. Once installed, the maintenance of grade crossings and their warning devices is generally the responsibility of the railroads.

Railroads invest heavily in grade crossing maintenance and safety, spending hundreds of millions of dollars each year to maintain crossings. Grade crossing designs currently use various roadway materials, such as asphalt, concrete, wood, rubber, steel, composite materials, and other like materials. All current roadway crossing designs utilize the support system of the railway track, consisting of sub-base materials, ballast, and ties. Specifically, the roadway material is typically placed on the ties and ballast, often connecting or otherwise tying the roadway material to the ties and/or ballast. The weakness in this system stems from the fact that the typical forces from railroad traffic often produces movements in the ties and ballast that in turn significantly degrade the roadway components. The connection between the track support system and the roadway support system often degrades the roadway faster than the railway system, requiring significant costs to repair for both the railroads and the local roadway authority.

A need, therefore, exists for an improved roadway crossing support structure at roadway and railway grade crossings. Specifically, a need exists for an improved roadway crossing support structure that separates the roadway support structure from the track support structure.

More specifically, a need exists for an improved roadway crossing support structure that utilizes an independent support system that uses foundation pile, support brackets, and connecting hardware to provide vehicle traffic road support.

Indeed, a need exists for an improved roadway crossing support structure that separates the support systems so that the roadway can last longer.

Moreover, a need exists for an improved roadway crossing support structure that prevents or minimizes degradation of the roadway support structure due to movement of track and ballast due to railroad traffic. Specifically, a need exists for an improved roadway crossing support structure that reduces the cost and allows for easier repair and replacement of roadway support structure.

SUMMARY OF THE INVENTION

The present invention relates to an improved roadway support system for railway grade crossings that uses a foundation pile, support brackets and connecting hardware to provide vehicle traffic road support separated from the railroad ballast and track support system. The present invention separates the roadway support system from the track support system so that the roadway support system can last longer and be repaired separately from the track support system.

To this end, in an embodiment of the present invention, a roadway support system for supporting roadway material at a railway grade crossing is provided. The roadway support system comprises: a first support bracket having a first end, a second end, and an elongated body between the first end and the second end, a top aperture disposed within a top side of the elongated body, and first and second opposing side walls extending from the top side of the elongated body, the first support bracket disposed between a pair of parallel railway tracks; a first pile rigidly connected to the elongated body and configured to extend downwardly from the elongated body into support material disposed beneath the first support bracket; and a first roadway material connector tying roadway material disposed on the top side of the elongated body of the first support bracket to the elongated body of the first support bracket.

In an embodiment, the support bracket has an inverted "U" shape.

In an embodiment, the roadway support system further comprises: a pile connector extending between the first side wall and the second side wall, and further wherein the pile connector extends through the pile thereby rigidly connecting the pile to the elongated body.

In an embodiment, the first side wall has a first side wall aperture and the second side wall has a second side wall aperture, and the pile connector is disposed through the first and second side wall apertures.

In an embodiment, the pile connector is a bolt disposed through the first and second side walls.

In an embodiment, the roadway material connector is disposed through the roadway material and connected to the elongated body of the support bracket.

In an embodiment, the roadway material connector comprises a bolt extending through the roadway support material and connected to the elongated body of the support bracket with a nut.

In an embodiment, the roadway support system further comprises: a second support bracket having a first end, a second end, and an elongated body between the first end and the second end, a top aperture disposed within a top side of the elongated body, and first and second opposing side walls extending from the top side of the elongated body; a second pile rigidly connected to the elongated body of the second support bracket and configured to extend downwardly from the elongated body of the second support bracket into the support material disposed beneath the second support bracket; and a second roadway material connector tying the roadway material to the elongated body of the second support bracket.

In an embodiment, the first support bracket and the second support bracket are disposed generally parallel to each other and the pair of railway tracks.

In an embodiment, the first support bracket and the second support bracket are disposed generally parallel to each other and generally perpendicular to the pair of railway tracks.

In an alternate embodiment of the present invention, a method of tying roadway material to support material without connecting the roadway material to a railway support system is provided. The method comprises the steps of: providing a pair of parallel railway tracks; providing a roadway material between the pair of parallel railway tracks configured to support vehicular traffic over the roadway material and the pair of parallel railway tracks; providing a first support bracket having a first end, a second end, and an elongated body between the first end and the second end, a top aperture disposed within a top side of the elongated body, and first and second opposing side walls extending from the top side of the elongated body, the first support bracket disposed between the pair of parallel railway tracks and beneath the roadway material; driving a first pile downwardly into the support material, the support material disposed beneath the first support bracket; connecting the first pile to the elongated body of the first support bracket; and tying the roadway material to the top side of the elongated body of the first support bracket via a first roadway material connector.

In an embodiment, the support bracket has an inverted "U" shape.

In an embodiment, the method further comprises the steps of: providing a pile connector; and connecting the pile to the elongated body of the first support bracket by extending the pile connector between the first side wall and the second side wall and through the pile.

In an embodiment, the first side wall has a first side wall aperture and the second side wall has a second side wall aperture, and the pile connector is disposed through the first and second side wall apertures.

In an embodiment, the pile connector is a bolt disposed through the first and second side walls.

In an embodiment, the roadway material connector is disposed through the roadway material and connected to the elongated body of the support bracket.

In an embodiment, the roadway material connector comprises a bolt extending through the roadway support material and connected to the elongated body of the support bracket with a nut.

In an embodiment, the method further comprises the steps of: providing a second support bracket having a first end, a second end, and an elongated body between the first end and the second end, a top aperture disposed within a top side of the elongated body, and first and second opposing side walls extending from the top side of the elongated body; driving a second pile downwardly into the support material, the support material disposed beneath the second support bracket; connecting the second pile to the elongated body of the second support bracket; and tying the roadway material to the top side of the elongated body of the second support bracket via a second roadway material connector.

In an embodiment, the first support bracket and the second support bracket are disposed generally parallel to each other and the pair of railway tracks.

In an embodiment, the first support bracket and the second support bracket are disposed generally parallel to each other and generally perpendicular to the pair of railway tracks.

It is, therefore, an advantage and objective of the present invention to provide an improved roadway crossing support structure at roadway and rail grade crossings.

Specifically, it is an advantage and objective of the present invention to provide an improved roadway crossing support structure that separates the roadway support structure from the track support structure.

More specifically, it is an advantage and objective of the present invention to provide an improved roadway crossing support structure that utilizes an independent support system that uses foundation pile, support brackets, and connecting hardware to provide vehicle traffic road support.

Indeed, it is an advantage and objective of the present invention to provide an improved roadway crossing support structure that separates the support systems so that the roadway can last longer.

Moreover, it is an advantage and objective of the present invention to provide an improved roadway crossing support structure that prevents or minimizes degradation of the roadway support structure due to movement of track and ballast due to railroad traffic.

Specifically, it is an advantage and objective of the present invention to provide an improved roadway crossing support structure that reduces the cost and allows for easier repair and replacement of roadway support structure.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to an improved roadway support system for railway grade crossings that uses a foundation pile, support brackets and connecting hardware to provide vehicle traffic road support separated from the railroad ballast and track support system. The present invention separates the roadway support system from the track support system so that the roadway support system can last longer and be repaired separately from the track support system.

Figure 1:
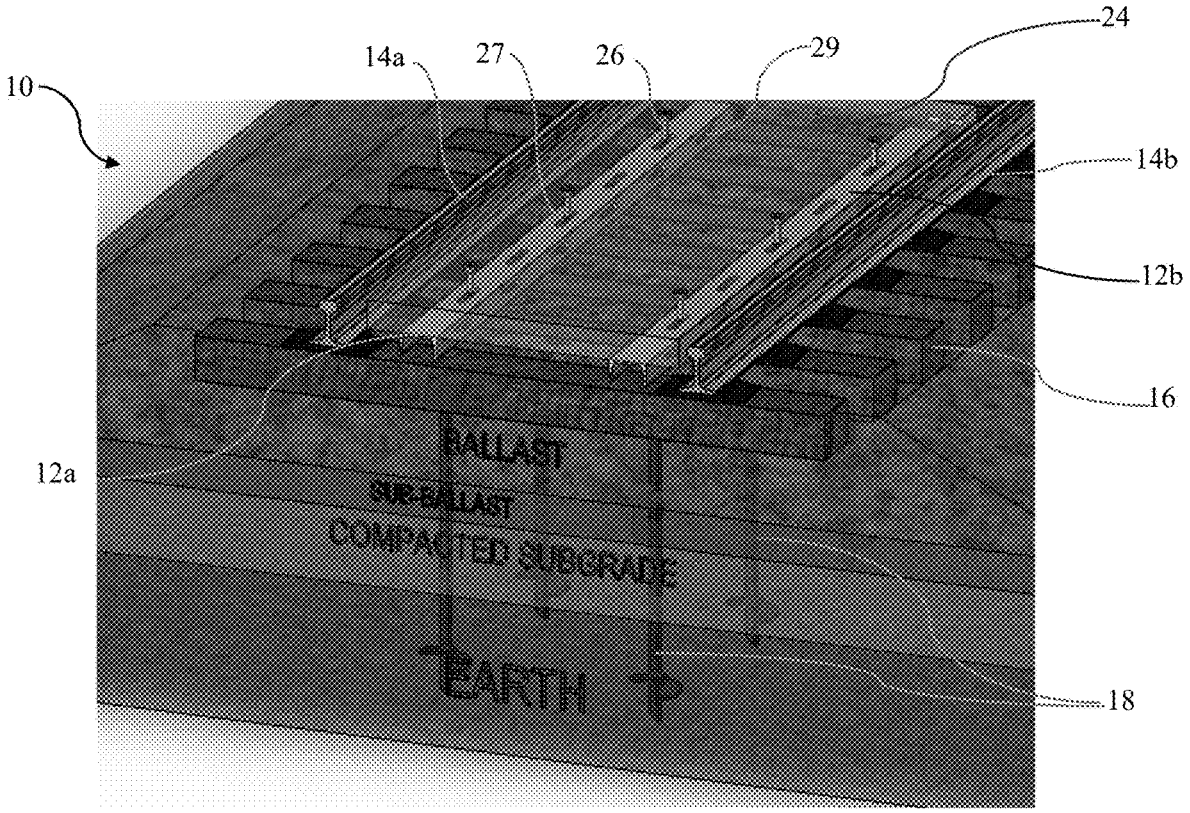
FIG. 1 illustrates a perspective cut-away view of a roadway support system for a railway grade crossing in an embodiment of the present invention.

Referring to the figures, FIG. 1 illustrates a perspective cut-away view of a roadway support system 10 in an embodiment of the present invention. The roadway support system 10 comprises a pair of elongated support brackets 12*a*, 12*b*, disposed in parallel relation with each other, and further disposed parallel to a pair of railroad rails 14*a*, 14*b*. Although shown as a pair of elongated support brackets, it should be apparent that any number of parallel elongated support brackets running parallel with the railroad rails may be utilized.

Figure 2:
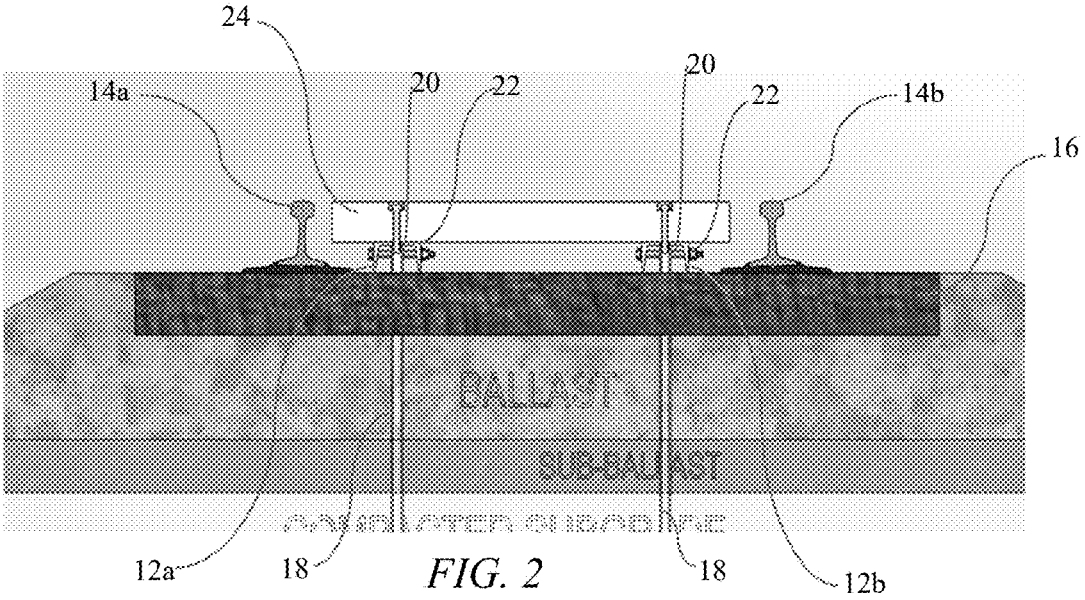
FIG. 2 illustrates a front cut-away view of a roadway support system for a railway grade crossing in an embodiment of the present invention.

The pair of elongated support brackets 12*a*, 12*b* may preferably have an inverted U-shape, as illustrated in FIG. 2, but may be any shape apparent to one of ordinary skill in the art, such as cylindrical, rectangular prism, or other like shape. Each of the elongated support brackets 12, 12*b* generally rests on ties 16 that support the railroad rails 14*a*, 14*b*, but are not tied to the ties 16. Generally, the pair of elongated support brackets 12*a*, 12*b* float on or above the ties 16.

A plurality of foundation piles 18 are connected to the pair of elongated support brackets 12*a*, 12*b* and are driven downwardly through the ballast, sub-ballast, compacted subgrade, and/or other support materials, and into the earth, as illustrated in FIG. 1, to provide support for the pair of elongated support brackets 12*a*, 12*b* and without connection or significant structural support from the ties 16. Therefore, the pair of elongated support brackets 12*a*, 12*b* have little, if any, support from the ties and/or ballast, and derive the bulk, if not all, support through the plurality of piles 18 that are driven into the ground.

The plurality of piles 18 may be connected to the elongated support brackets 12*a*, 12*b* through apertures 27 on a top of the elongated support brackets 12*a*, 12*b* via a connection bolt 20 and nut 22 that may be disposed through apertures 29 in the sides of the elongated support brackets 12*a*, 12*b*. Thus, the piles 18 may be rigidly connected to the elongated support brackets 12*a*, 12*b*, thereby providing the support thereof.

Figure 5:
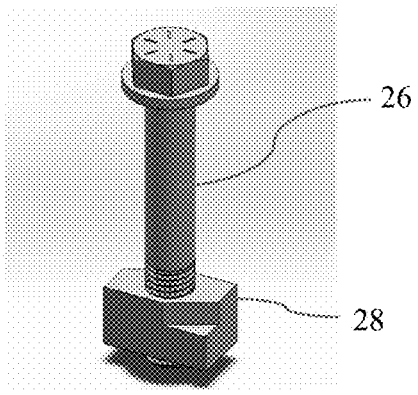
FIG. 5 illustrates a bolt and nut combination used to tie roadway material to a roadway support system in an embodiment of the present invention.
Figure 6:
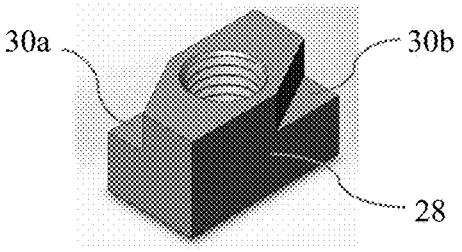
FIG. 6 illustrates a close-up view of a nut used in the bolt and nut combination used to tie roadway material to a roadway support system in an embodiment of the present invention.

Roadway material 24 may be disposed atop the elongated support brackets 12*a*, 12*b* and may be supported thereby, as illustrated in FIGS. 1 and 2. Bolts 26 may be placed within apertures (not shown) within the roadway material 24 and may extend downwardly through the roadway material 24 and into apertures within the top surface of the elongated brackets 12*a*, 12*b*, respectively. The bolts 26 may have a nut 28 on end thereof, as illustrated in FIGS. 5 and 6, that may have a shape that allows the nut 28 to be pre-placed on the bolt 26 prior to dropping down through an aperture in the roadway material 24 and into respective apertures in the top surface of the elongated support brackets 12*a*, 12*b*.

Once disposed therein, the bolt 26 may be turned, which in turn may rotate the nut 28 thereby locking the nut 28 within the apertures of the elongated support brackets 12*a*, 12*b* so that the nut 28 may be tightened to the bolt 28. Specifically, as illustrated in FIG. 6, nut 28 have may surfaces 30*a*, 30*b* that, when rotated due to tightening of the bolt 26, engages a bottom surface of the top side of the elongated brackets 12*a*, 12*b*, thereby preventing the nut from disengaging from the support brackets 12*a*, 12*b*.

The roadway material 24 may be any roadway material useful to holding vehicles driving thereover when crossing the railroad tracks at a grade crossing. The system 10 illustrated in FIGS. 1 and 2 may be particularly useful for steel plates, concrete slabs, composite, blacktop, or combinations thereof.

Figure 3:
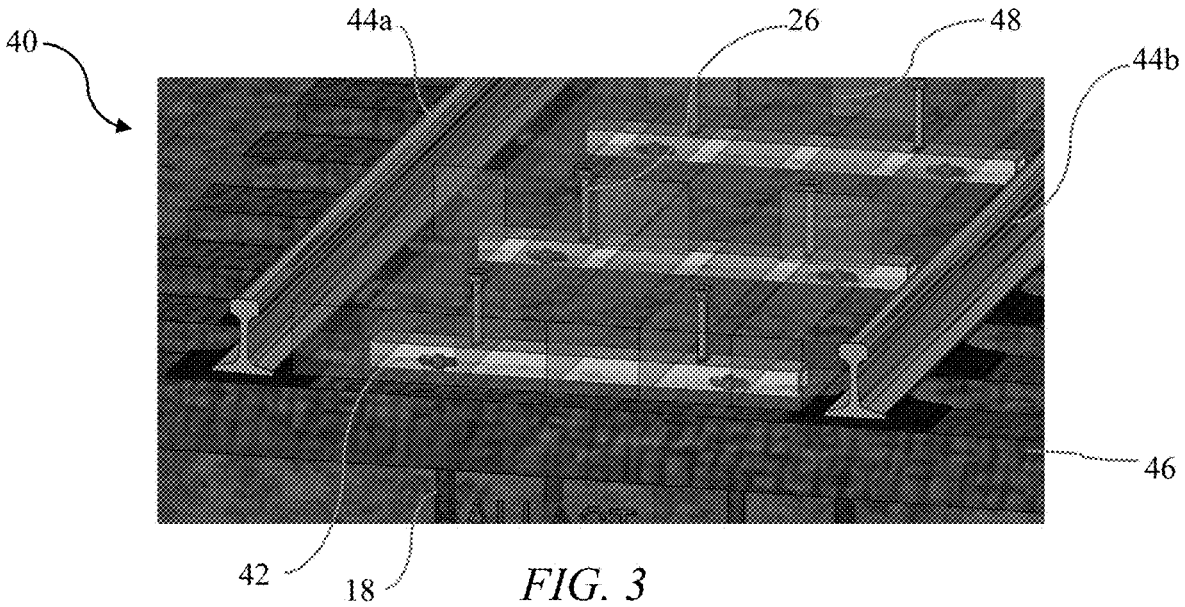
FIG. 3 illustrates a perspective cut-away view of a roadway support system for a railway grade crossing in an alternate embodiment of the present invention.

FIG. 3 illustrates a roadway support system 40 in an alternate embodiment of the present invention. The roadway support system 40 comprises a plurality of support bracket segments 42 disposed parallel to each other, but roughly perpendicular to railroad rails 44*a*, 44*b*. Preferably, each of the support bracket segments 42 may be positioned between ties 46 and may rest on the ballast beneath the ties, or float above the ballast. Generally, the support bracket segments 42 are not connected or tied to the ballast or the ties 46.

As with the support system 10, described above, the support bracket segments 42 may be tied to the earth via piles 18 that are driven through the ballast, sub-ballast, compacted subgrade, and any other track support fill material. The piles 18 may be connected to the support bracket segments 42 via bolts and nuts, as described above. Likewise, roadway material 48 may be disposed on a top side of each of the support bracket segments 42, and the bolts 26 and nuts 28, as described herein, may be used to tie the roadway material 48 to the support bracket segments 42. This embodiment may be useful when the road material comprises solid timbers that run parallel to the railroad rails 44*a*, 44*b*, as shown in FIG. 3.

Figure 4:
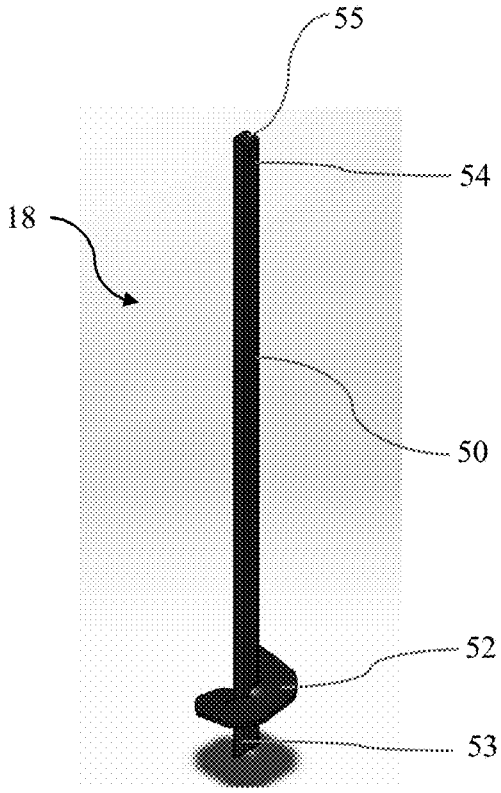
FIG. 4 illustrates a perspective view of a pile used to provide foundation support for the roadway support system of the present invention.

Preferably, the piles 18 comprise a rod 50 with a helical plate 52 disposed near a first end 53 thereof so that the same may be rotated via a rotating driver into the ground, as illustrated in FIG. 4. An aperture 54 may be disposed near a second end 55 so that the piles 18 may be attached to the elongated support brackets via the nut 20/bolt 22 combination through the sides of the support brackets, as illustrated in FIG. 2.

Thus, the roadway material 24, 48, as shown and described herein, may be tied to elongated support brackets or support bracket segments, which may in turn be supported via piles driven into the earth. Therefore, if railroad traffic on the rails causes pitching or heaving of the tracks, ties, ballast, and/or other support material, the roadway material will generally remain undisturbed, thereby decreasing degradation thereto, and allowing the roadway material to enjoy longer life and less costly repairs.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A roadway support system for supporting roadway material at a railway grade crossing comprising:

a first support bracket having a first end, a second end, and an elongated body between the first end and the second end, a top aperture disposed within a top side of the elongated body, and first and second opposing side walls extending from the top side of the elongated body, the first support bracket disposed between a pair of parallel railway tracks;

a first pile rigidly connected to the elongated body and configured to extend downwardly from the elongated body into support material disposed beneath the first support bracket; and a first roadway material connector tying roadway material disposed on the top side of the elongated body of the first support bracket to the elongated body of the first support bracket, wherein neither the first support bracket nor the roadway material are connected to a tie on which the pair of parallel tracks are connected.

2. The roadway support system of claim 1 wherein the support bracket has an inverted "U" shape.

3. The roadway support system of claim 1 further comprising:

a pile connector extending between the first side wall and the second side wall, and further wherein the pile connector extends through the pile thereby rigidly connecting the pile to the elongated body.

4. The roadway support system of claim 3 wherein the first side wall has a first side wall aperture and the second side wall has a second side wall aperture, and the pile connector is disposed through the first and second side wall apertures.

5. The roadway support system of claim 3 wherein the pile connector is a bolt disposed through the first and second side walls.

6. The roadway support system of claim 1 wherein the roadway material connector is disposed through the roadway material and connected to the elongated body of the support bracket.

7. The roadway support system of claim 1 wherein the roadway material connector comprises a bolt extending through the roadway support material and connected to the elongated body of the support bracket with a nut.

8. The roadway support system of claim 1 further comprising:

a second support bracket having a first end, a second end, and an elongated body between the first end and the second end, a top aperture disposed within a top side of the elongated body, and first and second opposing side walls extending from the top side of the elongated body;

a second pile rigidly connected to the elongated body of the second support bracket and configured to extend downwardly from the elongated body of the second support bracket into the support material disposed beneath the second support bracket; and a second roadway material connector tying the roadway material to the elongated body of the second support bracket.

9. The roadway support system of claim 8 wherein the first support bracket and the second support bracket are disposed generally parallel to each other and the pair of railway tracks.

10. The roadway support system of claim 8 wherein the first support bracket and the second support bracket are disposed generally parallel to each other and generally perpendicular to the pair of railway tracks.

11. A method of tying roadway material to support material without connecting the roadway material to a railway support system comprising the steps of:

providing a pair of parallel railway tracks;

providing a roadway material between the pair of parallel railway tracks configured to support vehicular traffic over the roadway material and the pair of parallel railway tracks;

providing a first support bracket having a first end, a second end, and an elongated body between the first end and the second end, a top aperture disposed within a top side of the elongated body, and first and second opposing side walls extending from the top side of the elongated body, the first support bracket disposed between the pair of parallel railway tracks and beneath the roadway material;

driving a first pile downwardly into the support material, the support material disposed beneath the first support bracket;

connecting the first pile to the elongated body of the first support bracket; and tying the roadway material to the top side of the elongated body of the first support bracket via a first roadway material connector, wherein neither the first support bracket nor the roadway material are connected to a tie on which the pair of parallel rails is connected.

12. The method of claim 11 wherein the support bracket has an inverted "U" shape.

13. The method of claim 11 further comprising the steps of:

providing a pile connector; and connecting the pile to the elongated body of the first support bracket by extending the pile connector between the first side wall and the second side wall and through the pile.

14. The method of claim 13 wherein the first side wall has a first side wall aperture and the second side wall has a second side wall aperture, and the pile connector is disposed through the first and second side wall apertures.

15. The method of claim 13 wherein the pile connector is a bolt disposed through the first and second side walls.

16. The method of claim 11 wherein the roadway material connector is disposed through the roadway material and connected to the elongated body of the support bracket.

17. The method of claim 11 wherein the roadway material connector comprises a bolt extending through the roadway support material and connected to the elongated body of the support bracket with a nut.

18. The method of claim 11 further comprising the steps of:

providing a second support bracket having a first end, a second end, and an elongated body between the first end and the second end, a top aperture disposed within a top side of the elongated body, and first and second opposing side walls extending from the top side of the elongated body;

driving a second pile downwardly into the support material, the support material disposed beneath the second support bracket;

connecting the second pile to the elongated body of the second support bracket; and tying the roadway material to the top side of the elongated body of the second support bracket via a second roadway material connector.

19. The method of claim 18 wherein the first support bracket and the second support bracket are disposed generally parallel to each other and the pair of railway tracks.

20. The method of claim 18 wherein the first support bracket and the second support bracket are disposed generally parallel to each other and generally perpendicular to the pair of railway tracks.

* * * * *